United States Patent [19]

Jochum et al.

[11] 4,368,588

[45] Jan. 18, 1983

[54] EXPLOSIVE POWDER DRIVEN FASTENING FASTENING ELEMENT SETTING DEVICE

[75] Inventors: Peter Jochum, Meiningen, Austria; Franz Buechel, Ruggell, Liechtenstein

[73] Assignee: Hilti Aktiengesellschaft, Schaan, Liechtenstein

[21] Appl. No.: 233,069

[22] Filed: Feb. 10, 1981

[30] Foreign Application Priority Data

Feb. 13, 1980 [DE] Fed. Rep. of Germany ..... 3005341

[51] Int. Cl.[3] ..... F41C 27/00; B25C 1/10

[52] U.S. Cl. ..... 42/1 R; 227/10

[58] Field of Search ..... 42/1 R, 1 M; 89/1 B, 89/26; 227/9–11

[56] References Cited

U.S. PATENT DOCUMENTS

| | | | |
|---|---|---|---|
| 3,572,729 | 3/1971 | Hodil, Jr. | 89/26 |
| 3,973,708 | 8/1976 | Scotoni | 227/10 |
| 4,063,672 | 12/1977 | Jochum | 227/10 |
| 4,138,788 | 2/1979 | Jochum | 42/1 R |

*Primary Examiner*—Charles T. Jordan

*Attorney, Agent, or Firm*—Toren, McGeady and Stanger

[57] ABSTRACT

A setting device arranged to use caseless propellent charges for driving fastening elements, such as bolts, nails and the like, into a hard receiving material includes a casing containing an axially slidable barrel forming a feed element at its rearward end. A counterpressure member is slidably movably supported within the casing and in combination with the end face of the feed element forms a combustion chamber for the caseless propellent charges. When the feed element is displaced rearwardly and forms a part of the combustion chamber, a ring located within the housing encircles its outside surface. The ring has a radially outer frusto-conical surface in contact with a complementary frusto-conical surface on the housing. When a caseless propellent charge is fired, propellent gases contact the ring and displace it along the frusto-conical surface on the casing causing it to be forced into sealing contact with the outside surface of the feed element.

5 Claims, 2 Drawing Figures

EXPLOSIVE POWDER DRIVEN FASTENING FASTENING ELEMENT SETTING DEVICE

SUMMARY OF THE INVENTION

The present invention is directed to a setting device using the force generated by an explosive powder for driving fastening elements, such as bolts, nails and the like, into hard receiving materials. The device includes a casing with a combustion chamber located within the casing. One side of the combustion chamber is defined by a feed member for moving caseless propellent charges into the chamber and the opposite side of the chamber is formed by a counterpressure member with ignition means extending through the counterpressure member into the combustion chamber. When the feed member forms one side of the combustion chamber its outside surface is sealed by a ring having a radially outer frusto-conical surface. When a propellent charge is fired, the propellent gases contact the ring and cause it to move into sealing contact with the feed member.

Due to the rising raw material costs of non-ferrous materials used for cartridge shells, the use of caseless propellent charges has again become interesting primarily for economic reasons. In addition to economic reasons, caseless propellent charges have additional advantages, for instance, a more compact packaging. There is a significant problem in the use of caseless propellent charges, however, that is, providing a seal for the combustion chamber. Extremely high pressure propellent gases are generated when a caseless propellent charge is fired and these gases escape through even the smallest gap in a seal causing a substantial drop in the propellent force of the charge. Conventional sealing rings are not capable of sealing the combustion chamber against such high pressure gases.

In a known setting device, the feed element is sealed by a ring which has a sealing cone. The propellent gases act on the ring and the ring is pressed against the sealing cone by the resulting force component. As the gas pressure increases, the ring is pressed more strongly against the sealing cone. Since the ring is subjected to substantial forces, a wear-resistant material is used for the ring. The use of such material, however, causes substantial wear in abutting parts. As a result, the casing containing the ring must be replaced when it becomes worn and such replacement is very expensive.

Therefore, it is the primary object of the present invention to provide a simple and effective arrangment for the sealing of the feed member.

In accordance with the present invention, the sealing action is effected by providing a frusto-conical sealing surface on the casing with the surface tapering inwardly away from the combustion chamber and with a similar frusto-conical surface formed on the ring. Unlike the arrangement in the known setting device mentioned above, in the present invention the ring is connected with the housing and for practical purposes is axially stationary. Due to this arrangement, possible wear does not occur in the casing, but rather on the feed member. If necessary, the feed member can be replaced much more easily than the housing. Since the ring encircles the outside surface of the feed member, this also results in a greater sealing surface being provided.

For manufacturing reasons, it is advantageous if the frusto-conical surface cooperating with the ring is formed on an insert releasably connected to the casing. The ring and the insert together form a unit. For effective interaction of these two parts, they can be ground or cut together prior to assembly. When it is necessary to replace the ring, the insert can be replaced at the same time. Thus, it can be ensured that the ring and the insert always fit together.

The various features of novelty which characterize the invention are pointed out with particularly in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figures 1, 2:
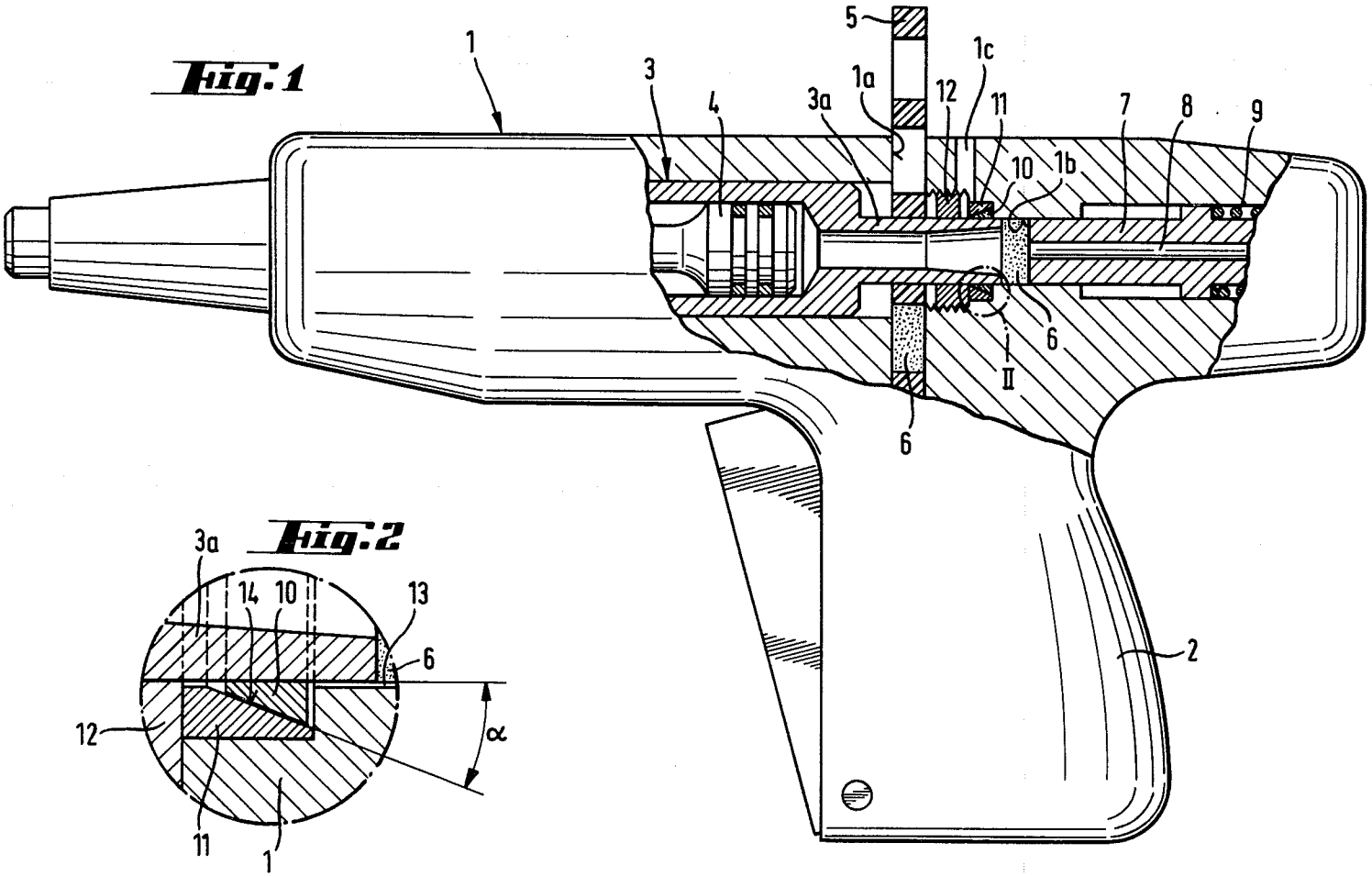
FIG. 1 is a side elevational view, partly in section, of a setting device embodying the present invention.
FIG. 2 is an enlarged detail of a portion of the setting device within the circle II in FIG. 1.

In FIG. 1 a setting device is illustrated formed by an elongated casing 1 having a handle 2 extending downwardly from the casing. As viewed in FIG. 1 the left-hand end of the casing is its front end and the right-hand end is its rear end. A barrel 3 is axially movably supported within the housing 1 having a front end or muzzle end at the front end of the casing and a rear end located within the casing. A piston 4 is displaceably guided within the barrel 3 for driving fastening elements out of the muzzle end of the barrel. A magazine passage 1*a* extends through the casing 1 perpendicularly of the axial direction of the barrel 3. Caseless propellent charges 6 are fitted into recesses in a magazine 5 located within the magazine passage 1*a*. The rear end of the barrel 3 forms a feed member 3*a* which presses a caseless propellent charge 6 out of the magazine 5 and moves the charge into a combustion chamber 1*b* within the casing 1. The movement of the barrel 3 and feed member 3*a* is effected by pressing the muzzle end of the barrel against the receiving material. As viewed in FIG. 1, the propellent charge 6 has been placed in the combustion chamber 1*b* and the chamber is defined in the axial direction by the surface of the casing 1 and transversely of the axial direction of the barrel it is formed on one side by the end face of feed member 3*a* and on the opposite side by the end face of a counterpressure member 7. The counterpressure member 7 has an axially extending bore therethrough aligned generally with the axis of the barrel and the bore serves to hold ignition means 8 for the charge within the combustion chamber. The ignition means 8 can be provided by an ignition electrode. The counterpressure member 7 is biased toward the front end of the casing 1 by a spring 9. When the muzzle end of the barrel is pressed against the receiving material, the counterpressure member is moved toward the rear end of the casing by the barrel 3 and the propellent charge 6 is displaced out of the magazine by the feed element 3*a*. FIG. 1 illustrates the propellent charge 6 located within the combustion chamber. When the barrel is displaced in the rearward direction, the feed member is encircled by a ring 10 with the rearward end face of the ring 10 being spaced a short distance in front of the combustion chamber 1*b*. When the propellent charge is fired, the ring 10 serves to seal the combustion chamber 1*b* around the outside surface of the feed member 3*a*. Any propellent gases which may still escape can be discharged to the exterior of the casing of the setting device through a discharge opening 1*c*. In FIG. 1, ring 10 is supported within an annular insert 11. The insert 11 is held in place within the housing 1 by a threaded sleeve 12. As can be seen in FIG. 1 the outer circumferential periphery of the sleeve is threaded and secured within a corresponding thread in the casing 1. The feed element 3*a* on the rearward end of the barrel 3 is slidably displaceable through the sleeve 12.

To afford a more clear illustration of the invention, the portion of the ring 10 enclosed within the circle II in FIG. 1, is illustrated in FIG. 2 on an enlarged scale. In FIG. 2, a portion of the housing 1 and the feed element 3*a* can be seen. A narrow gap 13 is present between the outside surface of the feed member 3*a* and the juxtaposed surface of the casing 1, when the feed element forms the front side of the combustion chamber 1*b*. When a caseless propellent charge 6 is fired in the combustion chamber 1*b*, propellent gases can flow through the gap 13 and press the end of the ring in the direction away from the the combustion chamber so that the frusto-conical surface of the ring tends to move over the frusto-conical surface 14 of the insert 11 so that the radially inner surface of the ring 10 is pressed against the outside surface of the feed member 3*a* and correspondingly the insert is pressed against the casing 1. The axially directed forces which are generated, are absorbed by the sleeve 12. As illustrated, insert 11 is releasably positioned in the casing 1. It is also possible, however, to form the insert as an integral part of the casing. The cone angle $\alpha$ of the frusto-conical sealing surface 14 is in the range of 20° to 30°, and preferably is 25°.

When a caseless propellent charge 6 fired in the combustion chamber 1*b* the propellent gases flow through the passageway in the feed element 3*a* into the forward portion of the barrel where they force the piston 4 toward the muzzle end of the barrel for driving the fastening element into a receiving material. After the fastening element driving operation is completed, and the setting device is removed from the receiving material, the barrel along with the feed element returns to a position forward of the magazine 5 with the feed element sliding through the ring 10 and the sleeve 12.

While specific embodiments of the invention have been shown and described in detail to illustrate the application of the inventive principles, it will be understood that the invention may be embodied otherwise without departing from such principles.

We claim:

1. A setting device adapted to use an explosive powder propellent for driving fastening elements, such as bolts, nails and the like, into a hard receiving material, with the powder propellent being in the form of a caseless propellent charge, comprising a casing, means within said casing for forming a combustion chamber, said means comprising an axially extending feed element displaceably positionable in the axial direction thereof within said casing, a counterpressure member in axial alignment with said feed element, said feed element forming one side of said combustion chamber and said counterpressure member forming an opposite side of said combustion member, a ring located within said casing and encircling said feed element, said ring having a radially inner surface arranged to contact the outside surface of said feed element and a radially outer frusto-conical surface with the frusto-conical surface tapering inwardly in the direction away from said combustion chamber, said casing having a frusto-conical surface arranged in contact with said frusto-conical surface on said ring with said frusto-conical surface on said casing tapering inwardly in the same direction as said frusto-conical surface on said ring and said ring being arranged to be contacted by propellent gases generated within said combustion chamber when a propellent charge is ignited so that the frusto-conical surface of said ring tends to be displaced along the frusto-conical surface of said casing in the direction away from said combustion chamber so that the inside surface of said ring is pressed against the outside surface of said feed element.

2. A setting device, as set forth in claim 1, wherein said casing includes an annular shaped removably insert having a radially inner surface forming said frusto-conical surface in contact with said frusto-conical surface on said ring.

3. A setting device, as set forth in claim 2, including a removable sleeve arranged in threaded engagement with said casing for securing said insert in position in said casing.

4. A setting device, as set forth in claim 1, 2 or 3, wherein said frusto-conical surfaces have a cone angle in the range of 20° to 30° relative to the axis of said feed element.

5. A setting device, as set forth in claim 4, wherein the cone angle of said frusto-conical surfaces is approximately 25°.

* * * * *